US005610351A

United States Patent [19]

Yanagisawa

[11] Patent Number: 5,610,351

[45] Date of Patent: Mar. 11, 1997

[54] MULTI-FACED BEATER FOR DRUMS

[75] Inventor: Mitsuo Yanagisawa, Yachio, Japan

[73] Assignee: Pearl Musical Instrument, Co., Chiba, Japan

[21] Appl. No.: 608,938

[22] Filed: Feb. 29, 1996

Related U.S. Application Data

[63] Continuation of Ser. No. 397,928, Mar. 3, 1995, abandoned.

[51] Int. Cl.[6] ..... G10D 13/02

[52] U.S. Cl. ..... 84/422.1

[58] Field of Search ..... 84/422.1, 422.2, 84/422.3, 422.4

[56] References Cited

U.S. PATENT DOCUMENTS

| | | | |
|---|---|---|---|
| 2,586,163 | 2/1952 | Heiderich et al. | 84/422.1 |
| 3,411,395 | 11/1968 | Hanes | 84/422.1 |
| 4,803,907 | 2/1989 | Minker | 84/422.1 |
| 5,263,395 | 12/1993 | Phillips | 84/422.4 |
| 5,317,946 | 6/1994 | Hoshino | 84/422.1 |

*Primary Examiner*—Cassandra C. Spyrou
*Attorney, Agent, or Firm*—Longacre & White

[57] ABSTRACT

A multi-task beater head having multiple striking surfaces for producing a variety of attack sounds, wherein the beater head may be adjusted or oriented in a convenient manner to achieve the desired attack sound. The drum beater incorporates a shaft that clamps into a receptor of a bass drum pedal, and a striker head that attaches to the other end of the shaft. The improved bass drum beater is molded from a hard plastic-type material or the like, and features a cube-like head with flat top and bottom surfaces and four faces, each with uniquely oriented convex shaped surfaces. The beater can be rotated by loosening the receptor of the bass drum pedal so that any of the plurality of surfaces is in position to strike the drum head. Thus, the percussionist can achieve a plurality of distinctly different bass drum sounds by choosing the appropriate surface.

17 Claims, 5 Drawing Sheets

MULTI-FACED BEATER FOR DRUMS

This is a continuation of application Ser. No. 08/397,928, filed Mar. 3, 1995, which was abandoned upon the filing hereof.

BACKGROUND OF THE INVENTION a) Field of the Invention

The invention is related to an improved beater for use with bass drum assemblies, wherein a pedal is used for striking bass drums commonly incorporated into musical instrument drum sets. More particularly, the invention provides a versatile beater design whereby the percussionist can achieve distinctly different drum sounds, or attack sounds, by choosing the appropriate beater surface.

b) Description of Related Art

An example of an ordinary drum pedal 100 is shown as FIGS. 1 and 2. The drum pedal 100 comprises a beater 110, an operating part 120 and a pedal 130. The pedal 100 is fixed to a bass drum 140 by a fixing member 105, such as a toe clamp. The drum pedal has a base and support 102. A spring 103 returns the beater to its retracted position.

The beater 110 comprises a rod 111 and a main beater body 112 on the rod. The rod 111 is fixed to the pedal axle 121 of the operating part 120. The main beater body 112 is typically made of felt. The rod 111 runs through the body 112 and the body 112 is installed at the tip of the rod 111 by a nut 113.

The operating part 120 is comprised of the pedal axle 121, a wheel 122 mounted on and rotatable with the axle 121 and a chain 123 trained on the wheel 122 and operable to rotate it. The pedal axle 121 is supported horizontally and freely rotatably at the top of the support 102. The rod 111 and the wheel 122 which rotates integrally with the rod 111 are provided on the axle 121.

The wheel 122 comprises a sprocket or a partial sprocket, and the chain 123 has an end which is fixed to the wheel 122 and is wound on its outer periphery. The other end of the chain 123 is connected to the free swinging tip of a foot pedal 131 of the pedal 130. As the foot pedal 131 is stepped on, the chain 123 is pulled down, which rotates the wheel 122 and the rod 111, thereby causing the main beater body 112 to beat the drum head 141 of the bass drum 140.

U.S. Pat. No. 5,317,946 to Hoshino teaches an arrangement wherein a beater head is supported to be selective adjustable in its orientation around an axis transverse to the longitudinal axis of the support rod of the beater head. As shown in FIG. 3, the striking surface 10*a* of the beater head 10 may be oriented to properly strike the drum face 141.

Conventional beater heads however are formed with a single striking surface as shown in FIG. 3, or are formed with a cylindrical or spherical head as shown in FIGS. 1 and 2.

The conventional beater heads are formed of one of a felt-type or wood material which produce particular attacks sounds upon striking the drum face. The softer felt-type material produces a relatively "warm" sound compared to the "hard" sound produced by beater head formed of the wood or rigid material. When a percussionist desires to alter the attack sound of the beater striking the drum face, the drum beater must be removed from the mounting 30 shown in FIGS. 1–3, and replaced with the beater formed with the appropriate material.

The need exists for a beater head having multiple striking surfaces for producing a variety of attack sounds, wherein a single multi-task beater may be adjusted or oriented in a convenient manner to achieve the desired attack sound. The need exists for a beater which can replace common task-specific beaters with a single multi-task beater.

SUMMARY OF THE INVENTION

The present invention discloses a multi-task beater head having multiple striking surfaces for producing a variety of attack sounds, wherein the beater head may be adjusted or oriented in a convenient manner to achieve the desired attack sound.

The invention discloses a bass drum beater incorporating a shaft that clamps into a receptor of a bass drum pedal, and a striker head that attaches to the other end of the shaft. Unlike common bass drum beaters that have a cylindrical or spherical shaped head made of felt or wood, the improved bass drum beater is molded from a hard plastic-type material and features a cube-like head with flat top and bottom surfaces and four faces, each with uniquely oriented convex shaped surfaces.

In the preferred embodiment of the invention, the convex surfaces are organized in opposite pairs, one pair molded of the plastic-type material itself and the other pair made of a soft felt-type material that is adhered to recesses in the body of the beater head. The softer felt-type material produces a relatively "warm" sound compared to the "hard" sound produced by the plastic-type material. The convex surfaces are oriented (relative to the shaft) as follows: horizontal on one member of each pair and vertical on the other member of each pair. The vertically oriented beater surfaces contact the drum head at a "spot." The horizontally oriented beater surfaces contact the drum head along a "line." Contact of the "spot" surface against the drum produces a noticeably sharper "attack" sound than contact from the "line" surface.

The beater can be rotated by loosening the receptor of the bass drum pedal so that any of the four surfaces is in position to strike the drum head. The percussionist can therefore achieve a plurality of distinctly different bass drum sounds by choosing the appropriate surface—"warm" with "sharp" attack; "warm" with "dull" attack; "hard" with "sharp" attack; or "hard" with "dull" attack. The invention preferably features a universal fit to all bass drum pedals.

Thus, the invention replace task-specific common beaters with a single multi-task beater; therefore: 1) saves money; 2) eliminates the need to exchange beaters when changing bass drum sounds.

DETAILED DESCRIPTION OF THE PREFERRED EMBODIMENT

Figure 1:
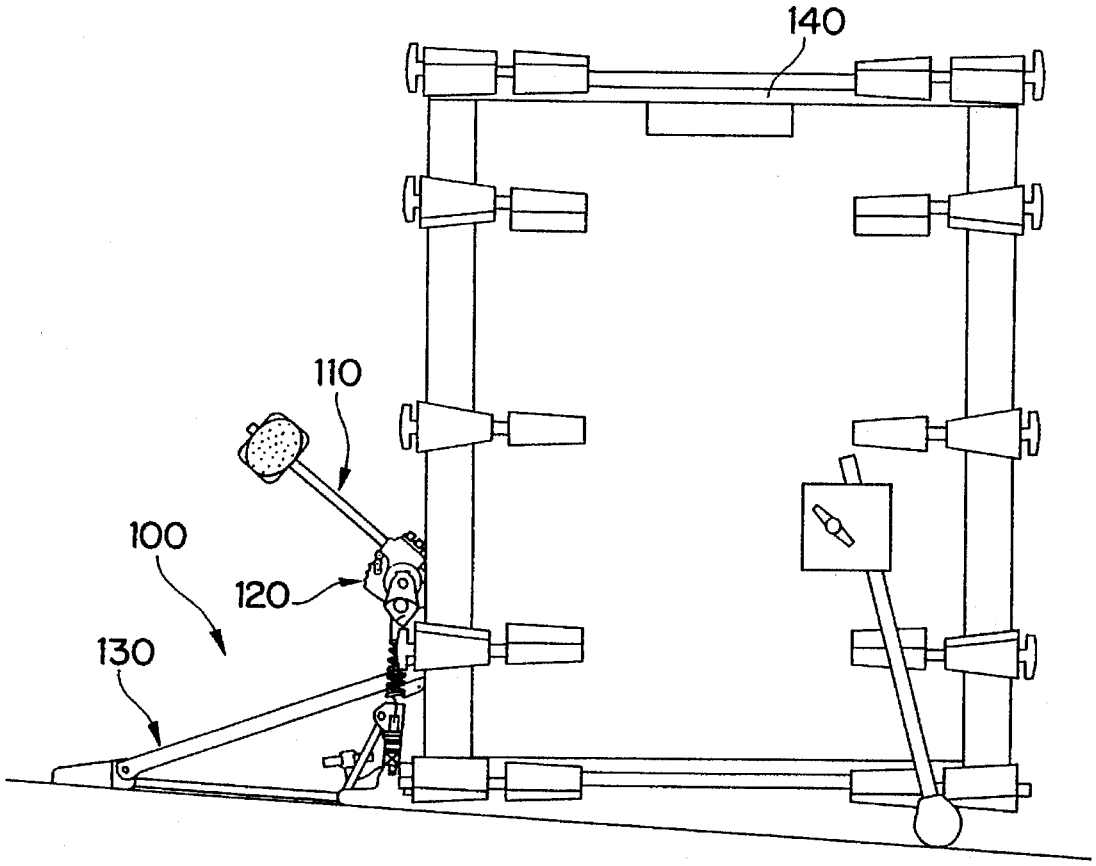
FIG. 1 PRIOR ART
FIG. 1 is a side view of a bass drum with an example of a beater of the drum pedal according to the prior art.
Figure 2:
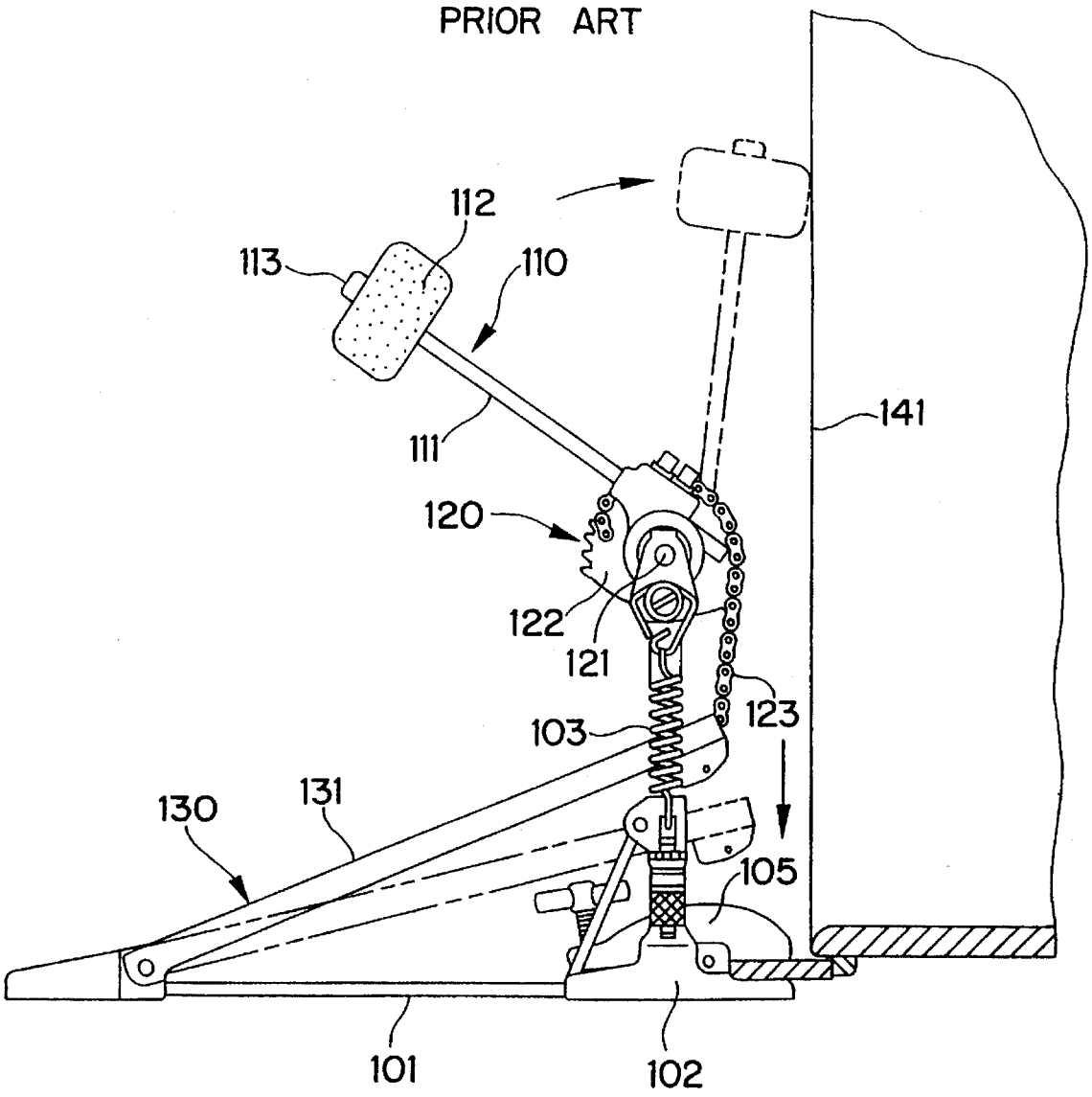
FIG. 2 PRIOR ART
FIG. 2 is a side view of the beater of FIG. 1 with the drum pedal part expanded.
Figure 3:
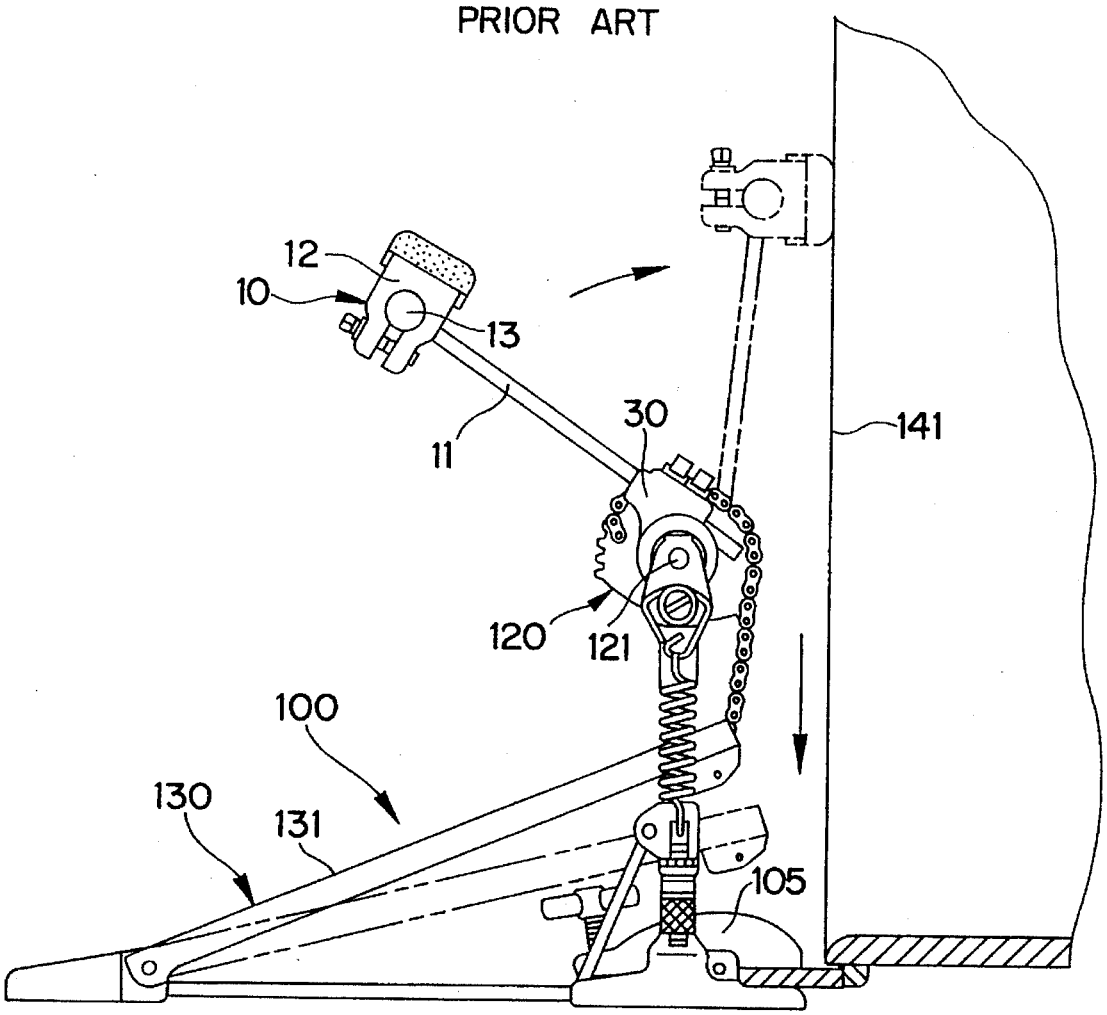
FIG. 3 PRIOR ART
FIG. 3 is a side view of a prior art beater having an beater head adapted for adjustment relative to its support rod.
Figure 4:
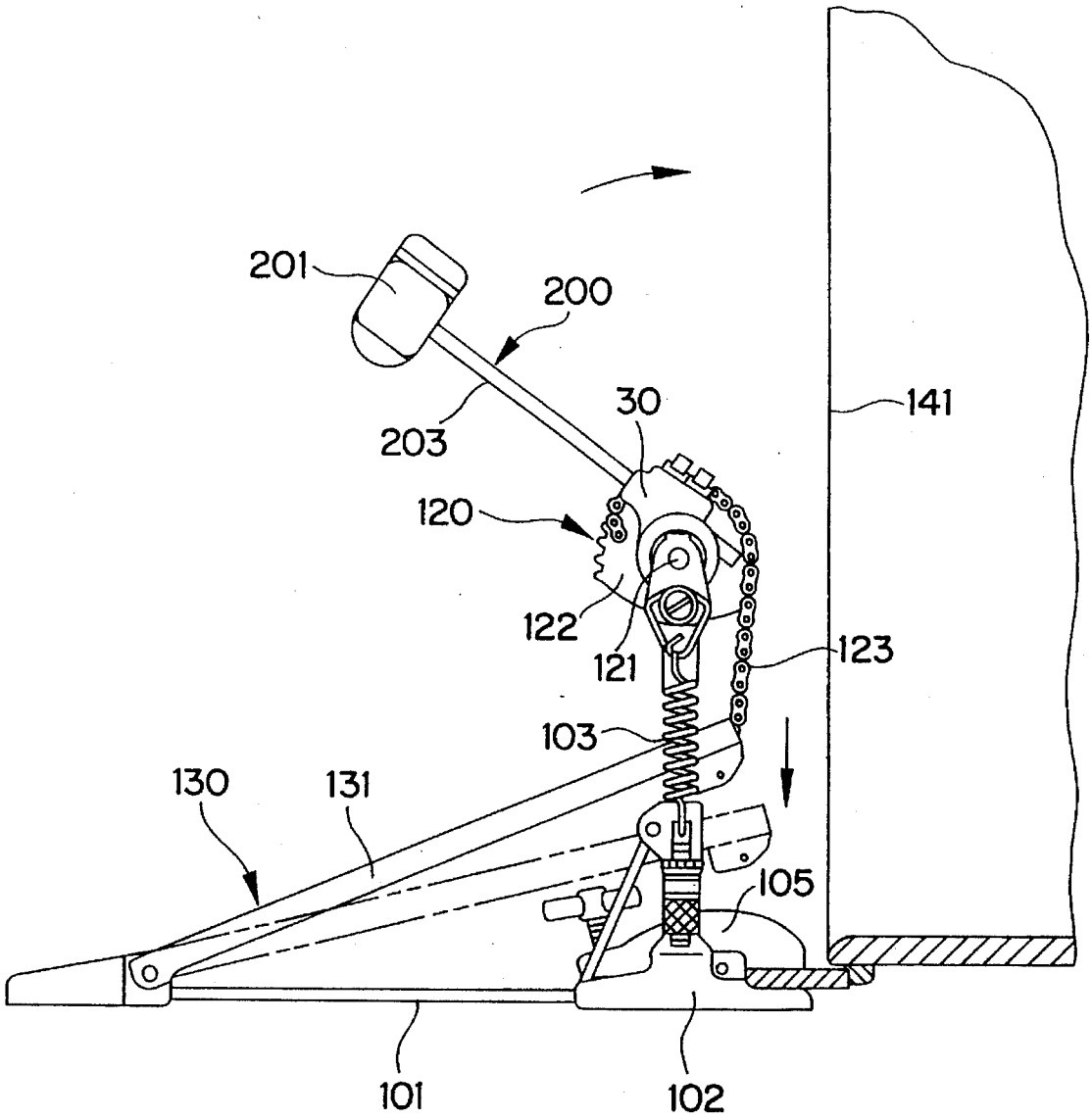
FIG. 4 is a side view of a bass drum with an example of a beater of the drum pedal according to the present invention.
Figure 8:
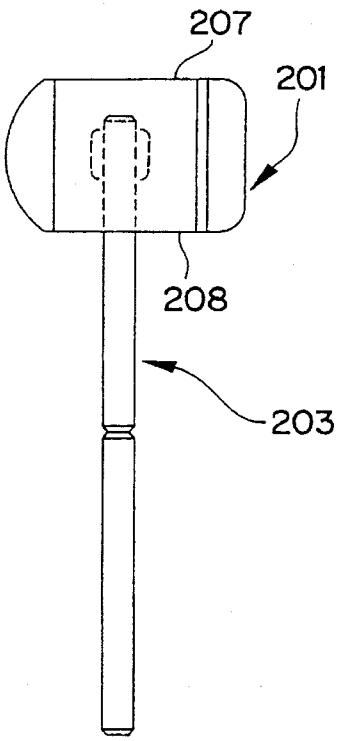
FIG. 8 is a cross sectional view of the drum beater of FIG. 6 taken along section lines VIII—VIII.
Figure 6:
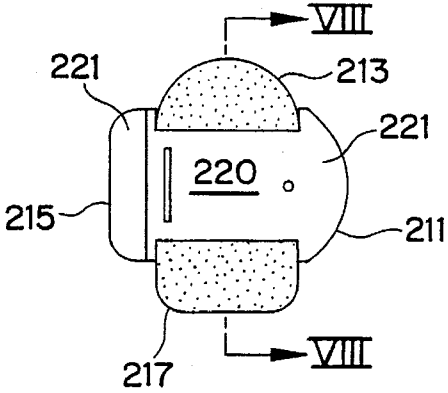
FIG. 6 is a top view of the drum beater shown in FIG. 5.
Figure 7:
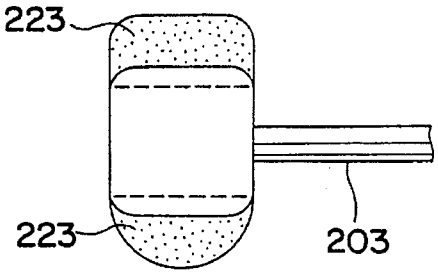
FIG. 7 is a partial side view of the drum beater shown in FIG. 5

FIG. 4 illustrates the preferred embodiment of the present invention whereby a multi-faced beater is mounted to a positioning member 30. It is noted that the basic elements comprising the foot pedal 130 and drum 141 are substantially identical to those elements illustrated in FIGS. 1–3 and described above with regard to the prior art of record. Of course, any foot pedal arrangement may be used with the multi-task beater forming the basis of the present invention.

The invention deviates from the teaching of the prior art by providing a beater 200 with a multi-surface beater head 201 affixed to a beater rod 203. The rod 203 is fixed to the pedal axle 121 through a positioning member 30 located on the shaft 121. The axle 121 serves as a pivot or swing axis for the rod 203. The positioning member 30 is provided with fastening means designed in accordance with techniques known to those of skill in the art.

Figure 5:
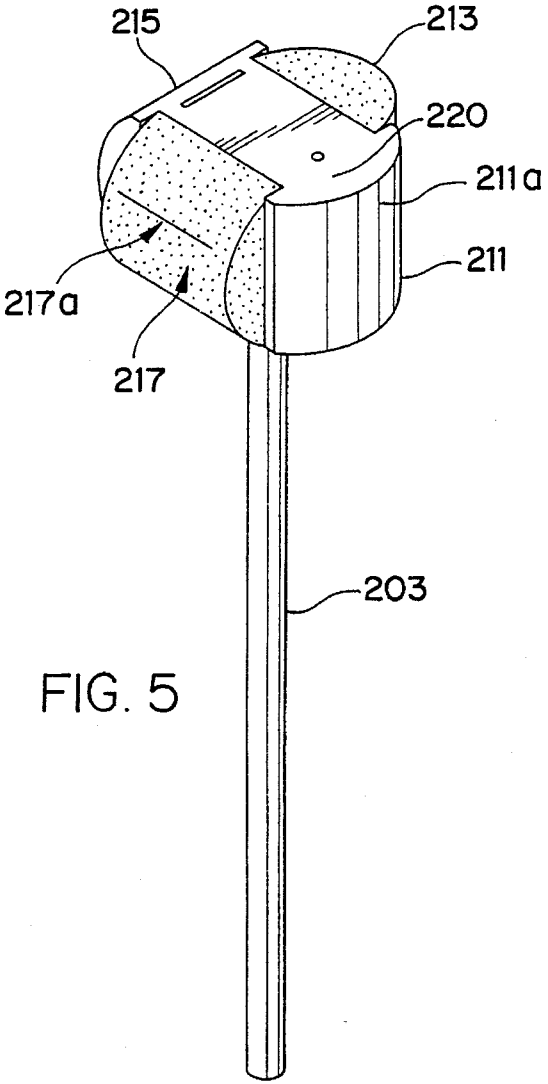
FIG. 5 is a perspective view of a drum beating according to the invention.

As shown in FIG. 5, the beater 201 of the invention comprises multiple striking surfaces 211,213, 215, 217; each arranged about peripheral portions of the beater head 201. The improved beater head 201 of the invention is preferably molded from a hard plastic-type material and features a cube-like design with flat top and bottom surface 207, 208 and four faces 211, 213, 215, 217. The beater head body 220 may alternately be formed from wood or other rigid material.

Each face 211, 213, 215, 217 is formed with uniquely oriented convex shaped surfaces. The convex surfaces are organized in opposite pairs, one pair molded of the rigid plastic-type material 221 itself and the other pair made of a soft felt-type material 223 that is adhered to recesses in the body 220 of the beater head 201. The softer felt-type material 223 produces a relatively "warm" sound compared to the "hard" sound produced by the plastic-type material 221.

The convex surfaces of each face 211, 213, 215, 217 are oriented (relative to the shaft) as follows: horizontal on one member of each pair and vertical on the other member of each pair. That is, the face 211 and the face 213 define vertically oriented convex surfaces, while the face 215 and the face 217 define horizontally oriented convex surface. The vertically oriented beater surfaces 211,213 contact the drum head 141 at a "spot" (see 211*a* of FIG. 5). The horizontally oriented beater surfaces 215, 217 contact the drum head 141 along a "line" (see doted line 217*a* of FIG. 5). Contact of the "spot" surface 211*a* against the drum 141 produces a noticeably sharper attack sound than contact from the "line" surface 217*a*.

With the design described above, two different contact points, i.e a line and a point, and two different beater head materials, i.e. plastic and felt, creates four different attack sounds from a single beater. The beater member 200 can be rotated or reoriented by loosening the positioning member 30 of the bass drum pedal so that any of the four surfaces is in position to strike the drum head 141. Thus, the percussionist can achieve a plurality of distinctly different bass drum sounds by choosing the appropriate surface—"warm" with "sharp" attack; "warm" with "dull" attack; "hard" with "sharp" attack; or "hard" with "dull" attack. The invention preferably enables a universal fit to all conventional bass drum pedals.

It is understood that the specific design described above is shown only by way of example and is not intended to limit the spirit and scope of the invention. For instance, any plural number of striking faces may be provided in order to enhance the number of different attack sounds achieve by a single beater.

Moreover, the beater design may be varied from the design illustrated in the accompanying drawings. For instance, the beater head 201 may be re-oriented with respect to the beater rod 203. In this arrangement, the beater head 201 is provided with fastening means for affixation relative to the rod 203. When a percussionist desires to alter the attack sound, this fastening means may be loosened in order that the head 201 may be re-oriented relative to the rod 203.

While the foregoing invention has been shown and described with reference to specific embodiments and designs, it is understood that the description above is not intended to limit the spirit and scope of the invention but are instead provided by way of example; therefore, changes in form and detail may be made therein with departing from the object of the invention.

I claim:

1. A drum engaging device for providing a plurality of drum sounds by varying a striking surface, said device having a plurality of striking surfaces, and a mounting means for orienting said beater head with respect to a drum face, whereby an orientation of said beater head defines an attack sound produced by said beater head striking said drum face, wherein said plurality of striking surfaces comprises at least two horizontally oriented convex surfaces and at least two vertically aligned convex surfaces defining at least four separate surfaces, said at least two horizontally aligned convex surfaces contacting said drum face along a line, and said at least two vertically aligned convex surfaces contacting said drum face at a point.

2. The drum engaging device of claim 1, wherein each of said plurality of striking surfaces comprises a degree of rigidity, said degree of rigidity affecting said attack sound.

3. The drum engaging device according to claim 1, wherein said two horizontally oriented convex surfaces which contact said drum face along a line defines a relatively dull attack sound.

4. The drum engaging device according to claim 1, wherein said two vertically aligned convex surfaces which contact said drum face at a point defines a relatively sharp attack sound.

5. The drum engaging device of claim 1, wherein said plurality of striking surfaces comprise at least one rigid striking surface and at least one felt surface.

6. The drum engaging device according to claim 1, where said beater head comprises two rigid striking surfaces and two felt striking surfaces, said at least two horizontally aligned convex surfaces comprising one each of said two rigid striking surfaces and said two felt striking surfaces.

7. A drum apparatus comprising a drum having a drum face, a drum engaging device, and a striking means for moving said drum engaging device into contact with said drum face, said drum engaging device comprising:

a beater head having at least four separate striking surfaces, at least two of said striking surfaces each including a line contact geometry for contacting said drum face along a line, and at least two of said striking surfaces each including a point contact geometry for contacting said drum face at a point, said point contact geometry being defined by a surface which extends parallel to and is rounded about a vertical direction, and a mounting means for orienting said beater head with respect to said drum face, said mounting means comprising a rod member to which said beater head is affixed, said rod member extending in said vertical direction, wherein said drum engaging device is adapted to provide a plurality of drum sounds by varying an orientation of said beater head with respect to said drum face, whereby said orientation of said beater head defines an attack sound produced by one of said line contact geometry and said point contact geometry striking said drum face.

8. The drum apparatus recited in claim 7, wherein said mounting means supports said beater head on said striking means through said rod member fastened to said striking means, said orientation of said beater head defined by a rotation of said rod member about its axis.

9. The drum apparatus recited in claim 8, wherein said striking means comprises a positioning means for selectively affixing and orienting said beater head relative to said drum face.

10. The drum apparatus recited in claim 9, wherein said striking means comprises a foot-operated pedal for pivoting said drum engaging device relative to said drum.

11. The drum apparatus recited in claim 7, wherein each of said line contact geometry and said point contact geometry comprises a degrees of rigidity, said degrees of rigidity affecting said attack sound.

12. The drum apparatus recite in claim 7, wherein said line contact geometry defines a relatively dull attack sound.

13. The drum apparatus recited in claim 7, wherein said point contact geometry defines a relatively sharp attack sound.

14. The drum apparatus recited in claim 7, wherein said line contact geometry is defined by a horizontally aligned convex surface, and said point contact geometry is defined by a vertically aligned convex surface.

15. The drum apparatus recited in claim 7, wherein said point contact geometry is defined by a vertically aligned convex surface.

16. The drum apparatus recited in claim 7, wherein said at least four separate striking surfaces comprise at least one rigid striking surface and at least one felt surface.

17. The drum apparatus recited in claim 7, where said beater head comprises two rigid striking surfaces and two felt striking surfaces.

* * * * *